US006409580B1

(12) United States Patent
Lougher et al.

(10) Patent No.: US 6,409,580 B1
(45) Date of Patent: Jun. 25, 2002

(54) RIGID POLISHING PAD CONDITIONER FOR CHEMICAL MECHANICAL POLISHING TOOL

(75) Inventors: Wayne Lougher, Phoenix; Timothy S. Dyer, Tempe, both of AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/817,554

(22) Filed: Mar. 26, 2001

(51) Int. Cl.[7] ..... B24B 1/00

(52) U.S. Cl. ..... 451/56; 451/41; 451/285; 451/287; 451/443

(58) Field of Search ..... 451/56, 443, 444, 451/41, 285, 287, 288

(56) References Cited

U.S. PATENT DOCUMENTS 5,554,064 A 9/1996 Breivogel et al.
5,868,605 A * 2/1999 Cesna ..... 451/41
5,885,147 A 3/1999 Kreager et al.
6,220,936 B1 * 4/2001 Quek ..... 451/41
6,220,941 B1 * 4/2001 Fishkin et al. ..... 451/63
6,227,954 B1 * 5/2001 Togawa et al. ..... 451/285
6,231,425 B1 * 5/2001 Inaba et al. ..... 451/5
6,234,883 B1 * 5/2001 Berman et al. ..... 451/286
6,273,798 B1 * 8/2001 Berman ..... 451/72

* cited by examiner

*Primary Examiner*—Eileen P. Morgan
(74) *Attorney, Agent, or Firm*—James L. Farmer

(57) ABSTRACT

The present invention is a method and apparatus for conditioning a polishing pad used for chemically mechanically polishing semiconductor wafers. The conditioning device includes a rigid elongated element that resists bowing or warping during the conditioning process. Abrasive elements are supported by a substantially planar bottom surface of the rigid element. The abrasive elements may have a diamond layer cut into a grid pattern to provide an abrasive surface. The conditioning device is preferably used to condition a polishing pad supported by a rigid platen. The conditioning device is pressed against and swept across the polishing pad by an actuator while the polishing pad is rotated to uniformly condition the polishing pad. This uniform conditioning, while avoiding the bowing and warping of the prior art, provides a superior conditioning process for the polishing pad.

19 Claims, 5 Drawing Sheets

RIGID POLISHING PAD CONDITIONER FOR CHEMICAL MECHANICAL POLISHING TOOL

TECHNICAL FIELD

The invention relates to semiconductor manufacturing and more specifically to a method to condition a polishing pad on a chemical mechanical polishing (CMP) tool. A rigid pad conditioner is swept across an orbiting polishing pad to condition the polishing pad. In a preferred embodiment, the pad conditioner has a grid pattern of abrasives on its lower surface and the polishing pad is supported by a rigid platen.

BACKGROUND OF THE INVENTION

A flat disk or "wafer" of single crystal silicon is the basic substrate material in the semiconductor industry for the manufacture of integrated circuits. Semiconductor wafers are typically created by growing an elongated cylinder or boule of single crystal silicon and then slicing individual wafers from the cylinder. The slicing causes both faces of the wafer to be extremely rough. The front face of the wafer on which integrated circuitry is to be constructed must be extremely flat in order to facilitate reliable semiconductor junctions with subsequent layers of material applied to the wafer. Also, the material layers (deposited thin film layers usually made of metals for conductors or oxides for insulators) applied to the wafer while building interconnects for the integrated circuitry must also be made a uniform thickness.

Planarization is the process of removing projections and other imperfections to create a flat planar surface, both locally and globally, and/or the removal of material to create a uniform thickness for a deposited thin film layer on a wafer. Semiconductor wafers are planarized or polished to achieve a smooth, flat finish before performing process steps that create the integrated circuitry or interconnects on the wafer. A considerable amount of effort in the manufacturing of modern complex, high density multilevel interconnects is devoted to the planarization of the individual layers of the interconnect structure. Nonplanar surfaces create poor optical resolution of subsequent photolithography processing steps. Poor optical resolution prohibits the printing of high-density lines. Another problem with nonplanar surface topography is the step coverage of subsequent metalization layers. If a step height is too large there is a serious danger that open circuits will be created. Planar interconnect surface layers are required in the fabrication of modern high-density integrated circuits. To this end, chemical-mechanical polishing (CMP) tools have been developed to provide controlled planarization of both structured and unstructured wafers.

CMP consists of a chemical process and a mechanical process acting together, for example, to reduce height variations across a dielectric region, clear metal deposits in damascene processes or remove excess oxide in shallow trench isolation fabrication. The chemical-mechanical process is achieved with a liquid medium containing chemicals and abrasive particles (commonly referred to as slurry) that react with the front surface of the wafer while it is mechanically stressed during the planarization process.

In a conventional CMP tool for planarizing a wafer, a wafer is secured in a carrier connected to a shaft. Pressure is exerted on the back surface of the wafer by the carrier in order to press the front surface of the wafer against the polishing pad in the presence of slurry. The wafer and/or polishing pad are then moved in relation to each other via motor(s) connected to the shaft and/or platen in order to remove material in a planar manner from the front surface of the wafer. Various combination of motions are known for moving the wafer and polishing pad in relation to each other, but typically the wafer is rotated and the polishing pad moved in either a linear, rotational or orbital manner.

For best planarization results, the polishing pad should be a uniform planar surface. However, various factors contribute to the non-planar shape of the polishing pad. During the manufacturing process of most polishing pads, each individual polishing pad is cut from a cylinder (cake) of polishing pad material. Imperfections in the surfaces of the polishing pads are created during the cutting process. In addition, windows, grooves, fluid holes and other processes are performed on the polishing pad prior to use that also create further imperfections in the surfaces of the polishing pads. These manufacturing imperfections are harmful to the planarization process.

Material is removed from the front surface of the wafer as the wafer is planarized. Some of the material becomes trapped in the polishing pad causing the polishing pad to become loaded and glazed with the material. This is a typical problem regardless of the type of motions undertaken by the wafer and polishing pad. However, conventional polishing pads moved linearly or rotationally do not have areas on the polishing pad that are continuously covered by the wafer. This allows deionized (DI) water, slurry or other fluids to be used to rinse away some of the material from all areas of the polishing pad, thereby reducing the problem. Orbital CMP tools, however, typically have areas of the polishing pad that are continuously covered by the wafer thereby reducing the ability to wash away material from the areas always covered by the wafer during the CMP process. Loading and glazing of the polishing pad for orbital tools are therefore particularly problematic. The polishing pad also loses material during the planarization process causing the polishing pad to lose its desired shape. It is typically desirable to have the surface of the polishing pad planar, but concave, convex and other shapes are also known in the art to be useful as contours for the polishing pad. Polishing pads are typically conditioned (reshaped and loaded material removed) between the time of unloading the old wafer and loading a new wafer. This allows the conditioning device to have complete access to the surface of the polishing pad.

Conventional conditioning devices have abrasives, most often diamonds, adhered to their bottom surface. However, Applicants have noticed that the random nature that the abrasives are fixed to the bottom surface of the conditioning device leads to nonuniform conditioning of the polishing pad. The bottom surfaces of conditioning devices used for orbital tools have been flexible, e.g. pneumatically supported or mounted to a flexible supporting surface. Prior art orbital CMP tools support the polishing pad with a flexible membrane. This allows the flexible conditioning device to conform to the flexible shape of the polishing pad and apply a uniform pressure against the polishing pad during the conditioning process. However, Applicants noticed that when a rigid surface was used to support the polishing pad on an orbital CMP tool, the conventional flexible conditioning device produced poor results. Specifically, Applicants noticed that the flexible conditioning device would "chatter", i.e. skip along the surface of the polishing pad. The chatter produced gouges in the polishing pad and resulted in nonuniform conditioning of the polishing pad. In addition, Applicants noticed the flexible conditioning devices would bow and warp if not built very carefully resulting in non-uniform conditioning of the polishing pad.

Conventional orbital tools use one or more springs or weights to generate the pressing force needed to press the conditioning device against the surface of the polishing pad. Relative motion is generated between the polishing pad and the conditioning device to condition the polishing pad. The conditioning of the polishing pad removes the material and glaze on the polishing pad and reshapes the polishing pad to a desired contour. Applicants noticed that the springs did not provide adequate process control over the conditioning process. The springs tended to fatigue over time resulting in gradually lowering pressing forces over the lifetime of the springs. Also, the pad thickness would decrease over the lifetime of the polishing pad thereby unloading the springs and decreasing the pressing force.

What is needed is a method and apparatus for conditioning a polishing pad supported by a rigid platen on an orbital CMP tool that avoids the problems of the prior art. Specifically, a conditioning device is needed that properly shapes and uniformly removes the material loaded in the polishing pad quickly, without unnecessarily shortening the life of the polishing pad.

SUMMARY OF THE INVENTION

The present invention conditions a polishing pad, preferably supported by a substantially rigid platen, used during chemical mechanical polishing while avoiding the problems of the prior art. An object of the invention is to provide a conditioning device that does not warp or bow and uniformly conditions the polishing pad. The conditioning device includes a rigid elongated element that provides the strength necessary to resist torsional forces during the conditioning of the polishing pad that cause conventional conditioning devices to warp or bow.

Abrasive elements are supported by a convex or, preferably, a substantially planar bottom surface of the rigid element. The abrasive elements may have a diamond layer arranged into a grid pattern to provide a uniform abrasive surface. The conditioning device is preferably used to condition a polishing pad supported by a rigid platen. The conditioning device is pressed on and swept across the polishing pad by an actuator while the polishing pad is oscillated about an axis, rotated or orbited. The rigid conditioning device provides a uniform conditioning of the polishing pad. This uniform conditioning, while avoiding the bowing and warping of the prior art, provides a superior conditioning process.

In a typical process, a holder of wafers is loaded into a CMP tool. The wafers are sequentially taken from the holder and loaded into one or more carriers. The carriers press the front surface of the wafer against a polishing pad supported by a rigid platen. The wafer may be held stationary or rotated while the polishing pad is orbited to generate relative motion between the wafer and polishing pad to planarize the front surface of the wafer. The planarization process will load the polishing pad with waste material from the wafer reducing the effectiveness of the polishing pad. In addition, the polishing pad will lose its desired shape as the portions of the polishing pad that had greater contact with the wafer will experience a faster removal rate resulting in dishing of the polishing pad. Once the planarization process has been complete, the wafer is preferably cleaned, dried and replaced in its holder.

The polishing pad now needs to be conditioned to prepare it for the next wafer. This may be accomplished by pressing and sweeping a rigid conditioning device across the surface of the polishing pad supported by a rigid platen. While the actuator sweeps and presses the conditioning device against the polishing pad, a motion generator moves the platen and polishing pad in relation to the conditioning device. The preferred motion is an oscillation of the polishing pad in a clockwise and counter-clockwise direction. The range of the oscillation may be between about plus and minus 45 to 360 degrees and is preferably plus and minus 50 degrees. The oscillating motion of the polishing pad and the motion of the conditioning device uniformly remove the waste material loaded in the polishing pad and reshapes the polishing pad. The polishing pad is now ready for the next wafer and for the process to start again. It should be noted that the conditioning of the polishing pad may be performed after every wafer or after a predetermined number of wafers have been planarized.

BRIEF DESCRIPTION OF THE DRAWINGS

The present invention will hereinafter be described in conjunction with the appended drawing figures, wherein like numerals denote like elements, and.

DETAILED DESCRIPTION OF EXEMPLARY EMBODIMENTS

An improved conditioning device for polishing pads utilized in the polishing of semiconductor substrates and thin films formed thereon will now be described. In the following description, numerous specific details are set forth illustrating Applicant's best mode for practicing the present invention and enabling one of ordinary skill in the art to make and use the present invention. It will be obvious, however, to one skilled in the art that the present invention may be practiced without these specific details. In other instances, well-known machines and process steps have not been described in particular detail in order to avoid unnecessarily obscuring the present invention.

Figure 1:
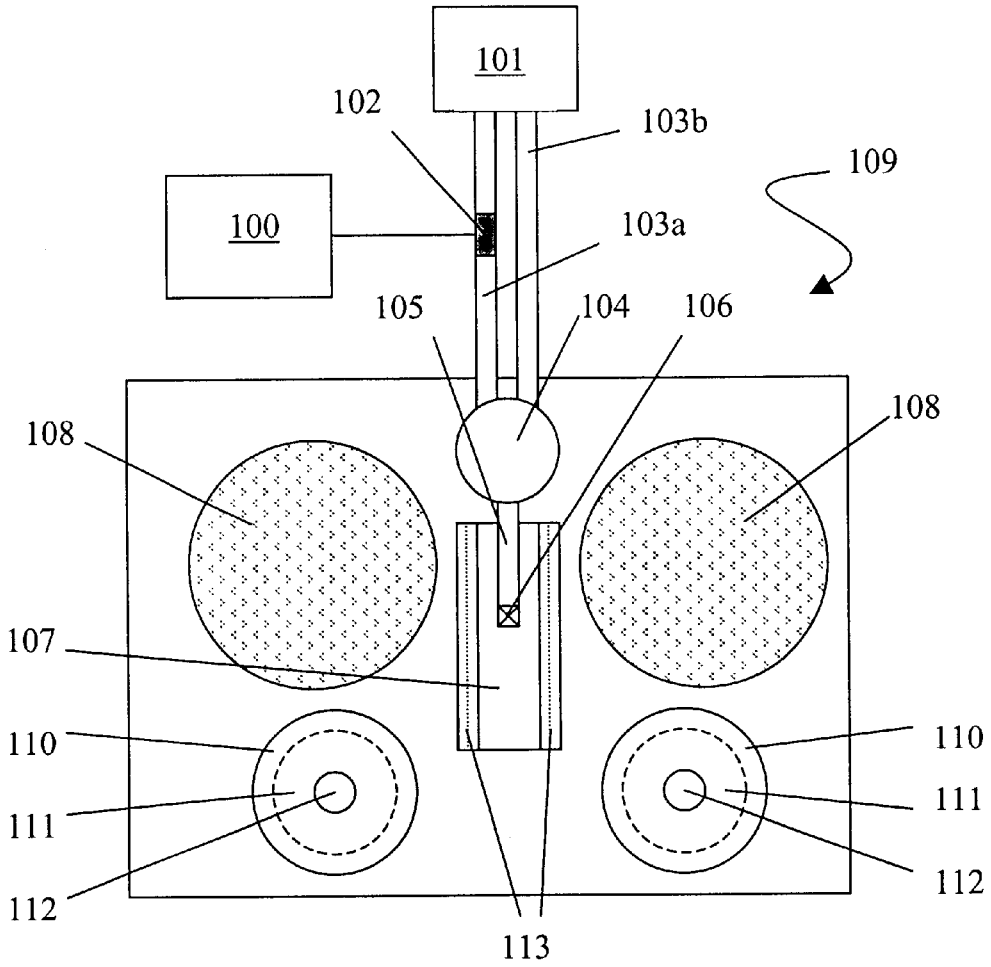
FIG. 1 is a top plan view of a polishing station along with exemplary pneumatic controls for a pad conditioner actuator.

FIG. 1 illustrates an exemplary polishing station 109 for practicing the present invention. Polishing stations, where the front surface of the wafer is planarized, are well known in chemical mechanical polishing (CMP) tools. The present invention is preferably practiced with a polishing station 109 having a plurality of polishing pads 108 that are orbited. Each polishing pad 108 is preferably suitable for polishing a single wafer 111 held by a carrier 110 at a time. Carriers 110 are well known in the art for providing a desired pressure, or combination of pressures, against the back surface of the wafer 111. Each carrier 110 is typically attached to a shaft 112 that may be attached to one or more motors or motion generating devices. These motors or motion generating devices may be used to allow the carrier 110 to rotate, move vertically and/or horizontally within the CMP tool. This allows the carrier 110 to transport the wafer 111 within the CMP tool to facilitate wafer handling within the CMP tool.

While the present invention will be described with an orbital motion of the polishing pads 108, other motions of polishing pads 108 are also well known in the art and may be used, e.g. rotational, vibrational or linear. An orbital motion of the polishing pad 108 or wafer 111 is preferred as it provides every point on the wafer 111 with the exact same relative motion against the polishing pad 108 as every other point on the wafer 111. The uniform motion provides a uniform removal rate of material across the front surface of the wafer 111. Polishing stations are also known to have one or more polishing pads coordinated with one or more carriers per polishing pad. However, the present invention is best used with a polishing station 109 having a plurality of polishing pads 108 where each polishing pad 108 utilizes a single carrier 110 at a time to planarize a wafer 111.

The invention may be used with a variety of polishing pads 108. The polishing pads 108 typically comprise a urethane based material. Examples of conventional polishing pads 108 that may be used with the invention are an IC1000 or an IC1000 supported by a Suba IV polishing pad. Both of these polishing pads 108, as well as others, are manufactured and made commercially available by Rodel Inc. with offices in Phoenix, Ariz. The particular polishing pad 108 selected for use is preferably optimized based on the material and condition of the front surface of the wafer 111.

Figure 2:
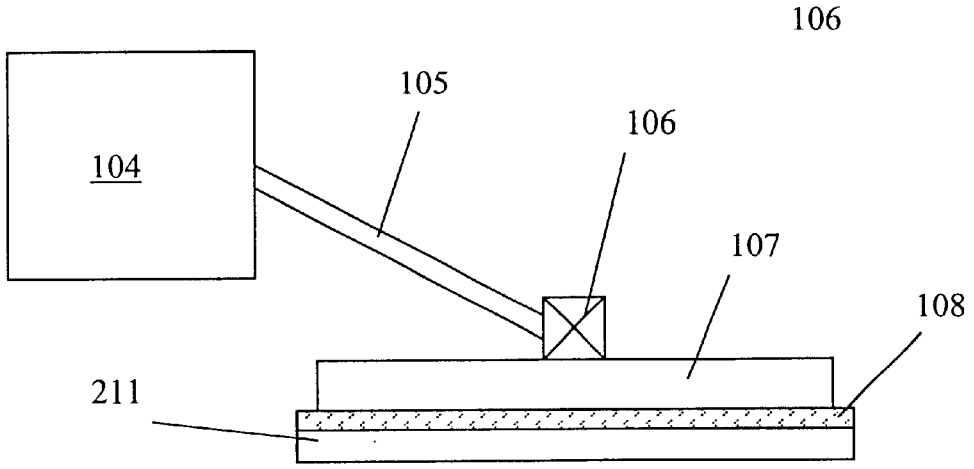
FIG. 2 is cross section view of the actuator and pad conditioner in contact with a polishing pad mounted to a supporting platen.

As shown in FIG. 2, the polishing pad 108 is preferably supported by a rigid platen 211. The platen 211 may comprise a rigid noncorrosive material such as titanium, ceramic or stainless steel. The platen 211 and polishing pad 108 may have holes (not shown) for delivering slurry or deionized water to the top surface of the polishing pad 108. The slurry may be used to place chemicals and abrasives at the wafer-polishing pad interface. The chemicals and-abrasives are used to enhance the planarization process by, for example, speeding up or improving the uniformity of the surface of the wafer. The slurry and deionized water may also be used to flush away debris from the top surface of the polishing pad 108 to limit the loading of material in the polishing pad 018. Also, a fluid, such as deionized water, may be delivered through the platen 211 and polishing pad 108 during the conditioning of the polishing pad 108 to assist in flushing the material loaded in the polishing pad 108 away.

Figure 5:
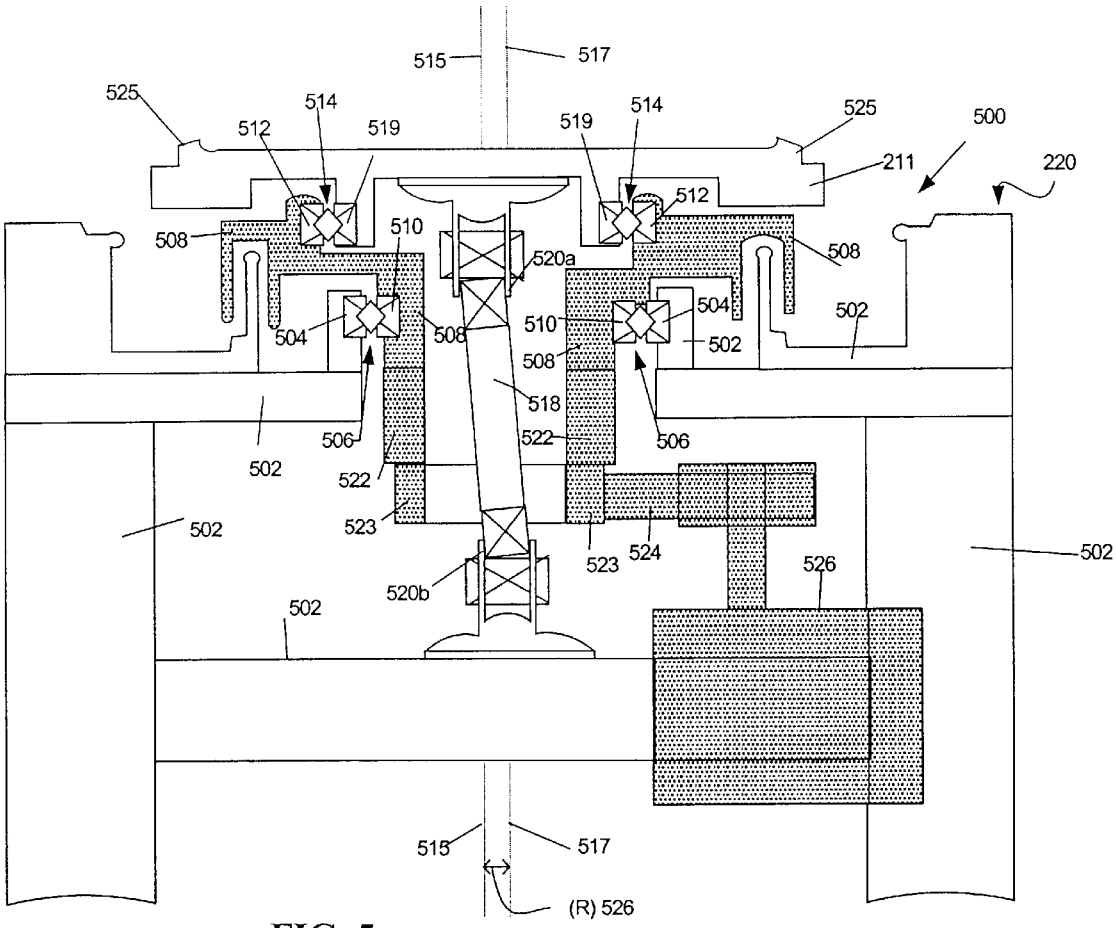
FIG. 5 is a cross section view of a method for producing an orbital motion for the polishing pad.

The polishing pad 108 is preferably orbited during the planarization process of the wafer 111 and rotated clockwise and counter-clockwise (between about plus and minus 45 to 360 degrees) during the conditioning of the polishing pad 108. FIG. 5 is a cross-sectional view of an exemplary motion generator 500 that may be used to generate an orbital motion for the platen 211 and polishing pad 108. The motion generator 500 is generally disclosed in U.S. Pat. No. 5,554,064 Breivogel et al. and is hereby incorporated by reference. Supporting base 220 may have a rigid frame 502 that can be securely fixed to the ground. Stationary frame 502 is used to support and balance motion generator 500. The outside ring 504 of a lower bearing 506 is rigidly fixed by clamps to stationary frame 502. Stationary frame 502 prevents outside ring 504 of lower bearing 506 from rotating. Wave generator 508 formed of a circular, hollow rigid body, preferably made of stainless steal, is clamped to the inside ring 510 of lower bearing 506. Wave generator 508 is also clamped to outside ring 512 of an upper bearing 514. Waver generator 508 positions upper bearing 514 parallel to lower bearing 506. Wave generator 508 offsets the center axis 515 of upper bearing 514 from the center axis 517 of lower bearing 506. A circular platen 211, preferably made of aluminum, is symmetrically positioned and securely fastened to the inner ring 519 of upper bearing 514. A polishing pad or pad assembly can be securely fastened to ridge 525 formed around the outside edge of the upper surface of platen 211. A universal joint 518 having two pivot points 520*a* and 520*b* is securely fastened to stationary frame 502 and to the bottom surface of platen 211. The lower portion of wave generator 508 is rigidly connected to a hollow and cylindrical drive spool 522 that in turn is connected to a hollow and cylindrical drive pulley 523. Drive pulley 523 is coupled by a belt 524 to a motor 526. Motor 526 may be a variable speed, three phase, two horsepower AC motor.

The orbital motion of platen 211 is generated by spinning wave generator 508. Wave generator 508 is rotated by variable speed motor 526. As wave generator 508 rotates, the center axis 515 of upper bearing 514 orbits about the center axis 517 of lower bearing 506. The radius of the orbit of the upper bearing 517 is equal to the offset (R) 526 between the center axis 515 of upper bearing 514 and the center axis 517 of the lower bearing 506. Upper bearing 514 orbits about the center axis 517 of lower bearing 506 at a rate equal to the rotation of wave generator 508. It is to be noted that the outer ring 512 of upper bearing 514 not only orbits but also rotates (spins) as wave generator 508 rotates. The function of universal joint 518 is to prevent torque from rotating or spinning platen 211. The dual pivot points 520*a* and 520*b* of universal joint 518 allow the platen 211 to move in all directions except a rotational direction. By connecting platen 211 to the inner ring 519 of upper bearing 514 and by connecting universal joint 518 to platen 211 and stationary frame 502 the rotational movement of inner ring 519 and platen 211 is prevented and platen 211 only orbits as desired. The orbit rate of platen 211 is equal to the rotation rate of wave generator 508 and the orbit radius of platen 211 is equal to the offset of the center 515 of upper bearing 514 from the center 517 of lower bearing 506.

It is to be appreciated that a variety of other well-known means may be employed to facilitate the orbital motion of the polishing pad. While a particular method for producing an orbital motion has been given in detail, the present invention may be practiced using a variety of techniques for orbiting the platen 211.

Referring back to FIG. 1, an actuator 104 may be connected to one distal end of an arm 105 to move the other distal end of the arm 105 vertically. The actuator 104 and polishing pads 108 may be positioned so that each conditioning device 107 may be used to condition more than one polishing pad 108. Various means may be used to power the actuator 104, e.g. electrical motor, hydraulics, but the actuator 104 is preferably pneumatic controlled. In a preferred embodiment, the actuator 104 is powered by a pump 101 moving pressurized air through pressure lines 103*a* and 103*b*. A pressure regulator 102 may be inserted into the pressure line 103*a* to further refine the movements of the arm 105 connected to the actuator 104. The pressure regulator 102 may be adjusted while the conditioning device 107 or distal end of the arm 105 is pressed against a load cell (not shown). Once the desired force is obtained according to the load cell, the pressure regulator 102 may be adjusted to the pressure necessary when needed. In addition, a controller 100 (computer or other electronic device) may be used to set the pressure regulator 102 to a desired pressure automatically as needed. The controller 100 may be used to automate the entire CMP tool and to coordinate the movements of the conditioning device 107 with the rest of the CMP tool.

Figure 6:
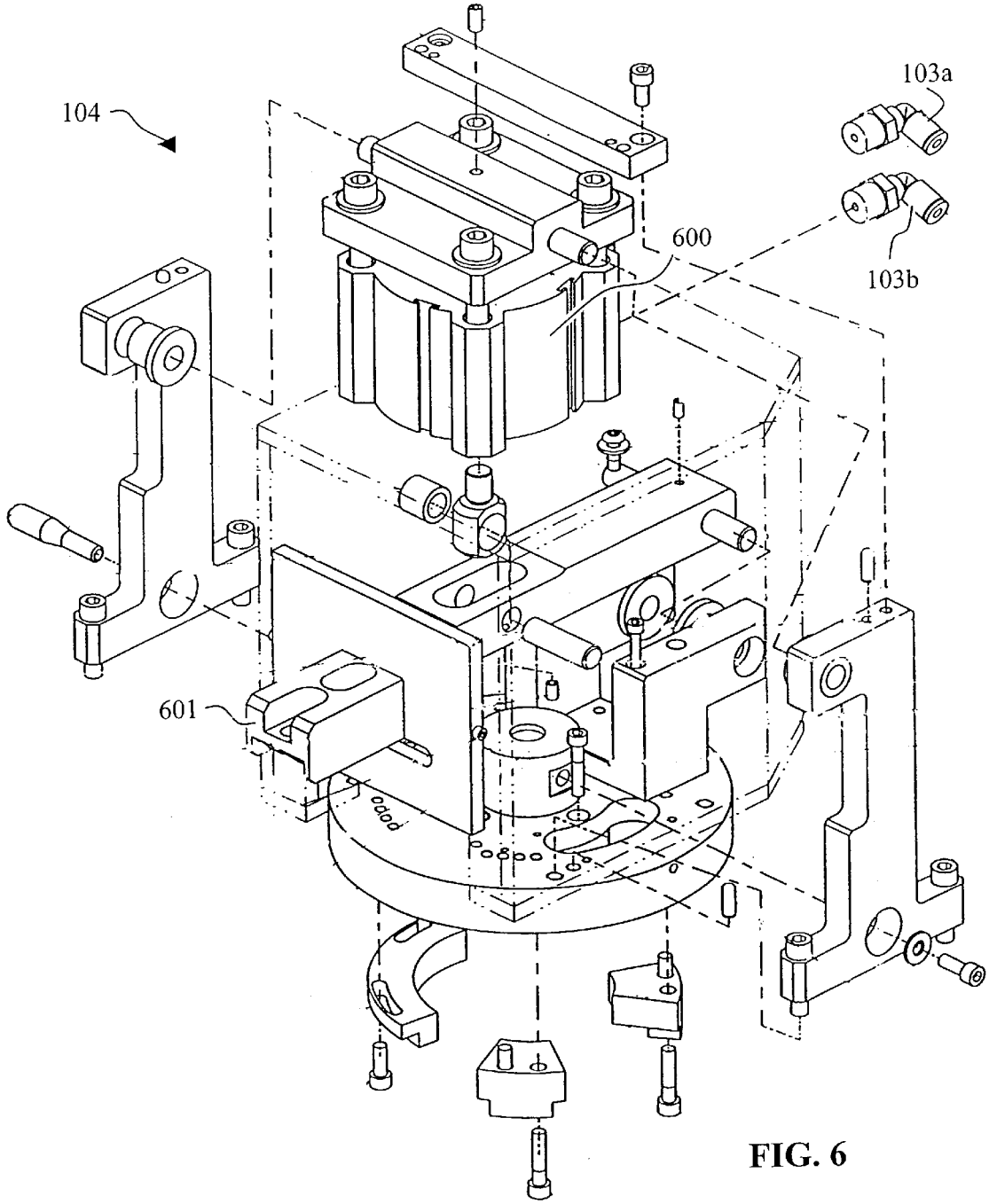
FIG. 6 is an exploded view of an exemplary actuator for the pad conditioner.

An example of one particular embodiment of an actuator 104 is illustrated in FIG. 6. The actuator 104 receives pressurized air at inlet 103*a* and returns the pressurized air through outlet 103*b*. The pressurized air is generated from a pump 101 (shown in FIG. 1). The pressurized air presses element 600 down and against end-effector 601 that may be connected to the pad conditioner arm 105 (shown in FIG. 1). The actuator 104 is thus able to provide a down-force for a conditioning device onto a polishing pad as needed. While an exemplary pneumatic actuator 104 is shown in FIG. 6, other types of actuators, for example an actuator powered by an electrical motor or springs, may also be used.

Pneumatic actuators 104 are preferred over spring actuators since the down-force for spring actuators changes as the pad thickness decreases over the lifetime of the polishing pad. In contrast, pneumatic actuators 104 may be regulated with the desired down-forces automated by the CMP tool. Pneumatic actuators 104 may also more easily provide higher down-forces and/or provide different down-forces as desired.

As shown in FIG. 2, a conditioning device 107 is connected to a distal end of the arm 105, preferably through a pivot point 106, near the center of the conditioning device 107. The pivot point 106 advantageously allows the conditioning device 107 to pivot only in the direction along the length of the conditioning device 107. Any slack or play in the pivot point 106 in the direction along the width of the conditioning device 107 would allow the conditioning device to dip into and gouge the polishing pad 108 resulting in nonuniform conditioning of the polishing pad 108. In addition, the pivot point 106 preferably places the focal point of the pivot point 106 as close to the polishing pad-conditioning device interface as possible. The pivot point 108 is preferably a cylinder allowed to rotate within a cylinder housing in the direction of the length of the conditioning device 107, but may also be an air bearing or other gimballing type device. The pivot point 106 allows the conditioning device 107 to align itself with the top surface of the polishing pad 108 during conditioning of the polishing pad 108. This allows the polishing pad 108 to receive a substantially uniform pressure from the conditioning device 107 along the length of the conditioning device 107. While a single pivot point 106 has been specifically described, multiple contact or pivot points between the arm 105 and the conditioning device 107 may also be used in evenly distributing the pressing force along the length of the conditioning device 107 on the polishing pad 108.

Figure 3:
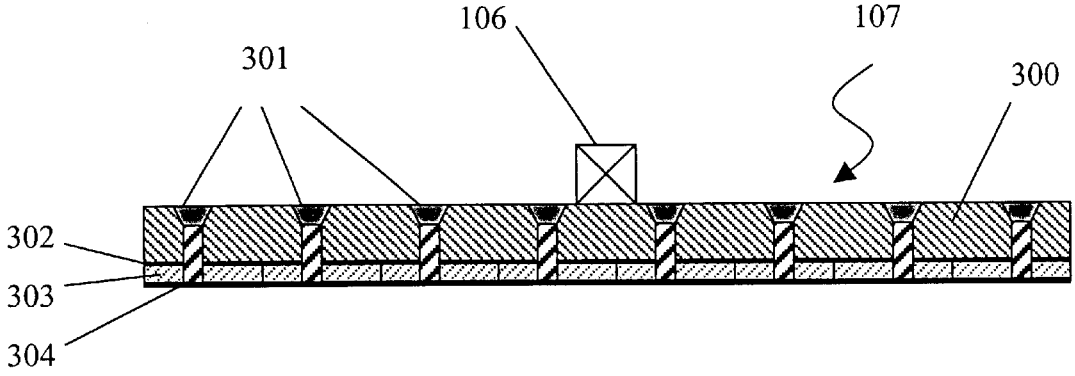
FIG. 3 is a cross section view of the pad conditioner.
Figure 4:
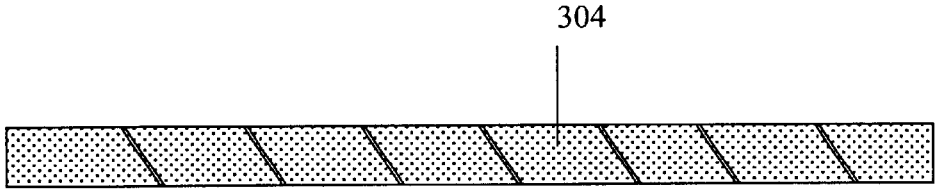
FIG. 4 is a bottom view of the pad conditioner showing an exemplary grid pattern for abrasives.

An exemplary conditioning device 107 will now be described with reference to FIGS. 3 and 4. An elongated element 300 may be used to provide the structural strength of the conditioning device 107. A rigid elongated element 300 prevents the conditioning device 107 from bowing or warpping as the prior art conditioning devices for orbital CMP tools do. The elongated element 300 is therefore preferably made of a rigid noncorrosive material such as stainless steal or titanium. The elongated element 300 needs a top surface, not necessarily planar, for receiving a pressing force through one or more pivot points 106. The elongated element 300 also has a bottom surface for supporting abrasive elements 303 with an abrasive surface 304. The bottom surface of the rigid element 300 is preferably planar. The abrasive elements 303 may be attached to the elongated member 300 via an epoxy layer 302 and/or screws 301. The abrasive elements 303 are ideally a solid bar of continuous diamonds, but may be broken into multiple segments to achieve better planarity when attached to the elongated element 300. The abrasive surface 304 preferably comprises a diamond layer that has a grid pattern. The grid pattern may be cut into the diamond layer by a high pressure water stream. The grid pattern has been shown to produce a more uniform conditioning of the polishing pad. The diamonds may be brazed or otherwise adhered to the surface of the abrasive elements 303. Suitable abrasive elements 303 may be purchased from 3M under the tradename M125-APC with abrasive surfaces under the tradename Diamond Grid Abrasive, type "D", "G", or "J". These products have been found to be very desirable as they greatly minimize the loss of diamonds from their abrasive surfaces that might scratch the wafer when compared to other similar products.

The conditioning device 107 may be made using the following procedure. The abrasive element(s) 303 are placed with the abrasive side down on a planar surface. The non-abrasive side of the abrasive element(s) 303 may then be coated with an epoxy 302. The bottom surface of the elongated element 300 may then be carefully placed on top of the epoxy 302, thereby adhering the abrasive element(s) 303 to the bottom planar surface of the elongated element 300. After the epoxy layer 302 has dried, screws 301 may be used to further attach the abrasive element(s) 303 to the elongated member 300. Care should be taken not to over tighten the screws 301 as this might warp the abrasive elements 302 and the abrasive surface 304.

With reference back to FIG. 1, nozzles 107 may be attached to the conditioning device 107. The nozzles 107 are feed through plumbing that allow a stream of fluid to be ejected during the conditioning of a polishing pad 108. Fluids may be chosen that enhance the removal of waste material from the wafer 111 and polishing pad 108 and conditioning of the polishing pad 108. For example, fluids may be chosen that dissolve the waste material thereby making it easier to flush or transport the waste material away. Deionized water may also be used to flush the waste material away without unduly interfering with the chemistry used during the planarization process. Oxalic acid has been found to work particularly well for removal of copper debris from the polishing pad 108 when polishing wafers 111 with a copper surface.

Figure 7:
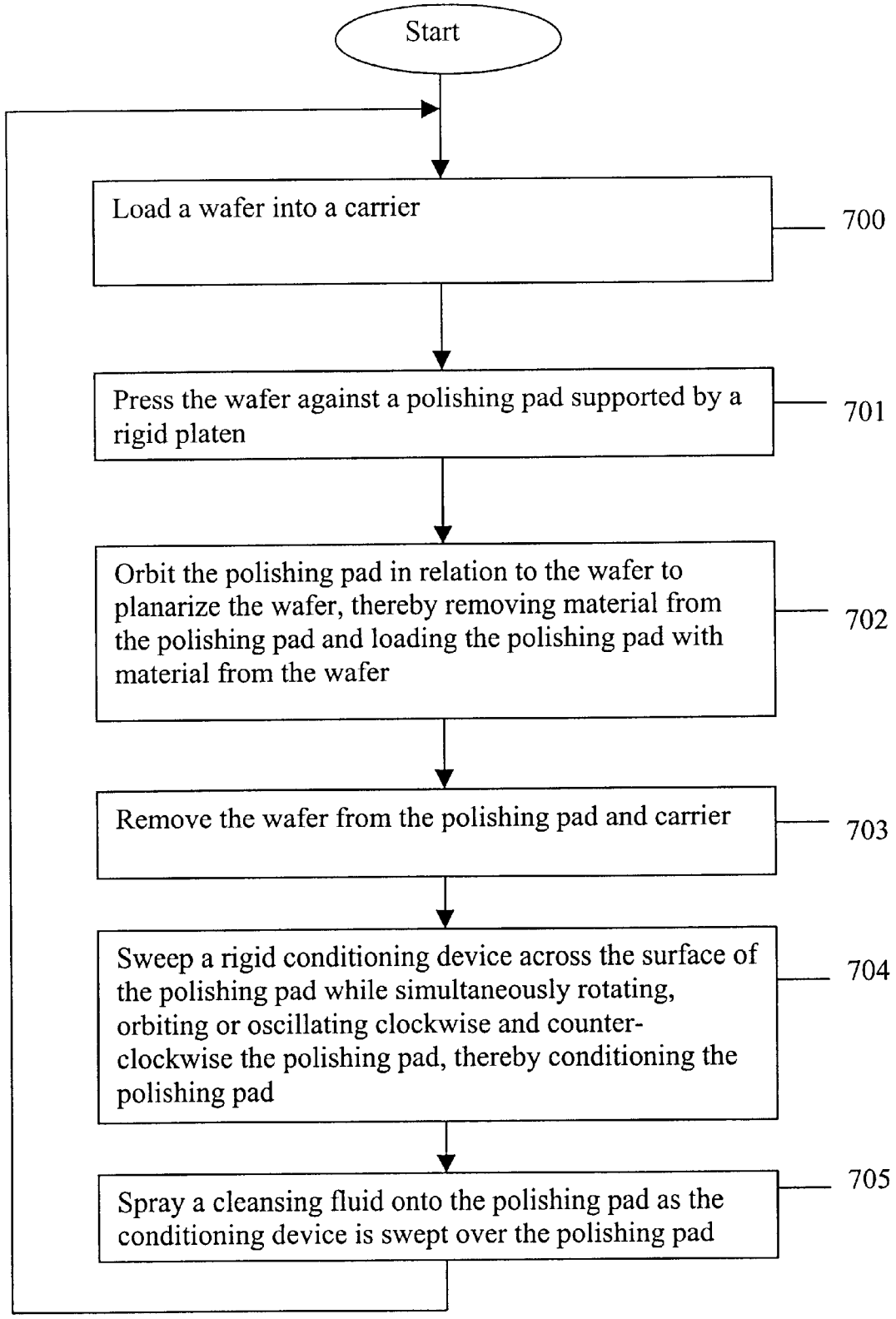
FIG. 7 is a flowchart of an exemplary method to practice the present invention.

A method for planarizing a front surface of a wafer 100, according to one embodiment of the invention, will now be described with reference to FIGS. 1 and 7. Wafers ready for CMP processing are typically contained in a cassette or other standardized holder and placed onto a CMP tool. Robots, water tracks or other means may be used to sequentially unload the wafers from their holders and transport the wafers to a position for loading into a carrier 110. (Step 700) The carrier 110, now holding a wafer 111 (typically by suction), may then be moved by its shaft 112 via motors, pneumatics or other means to a position over the polishing pad 108. Pneumatics or other means attached to the shaft 112 of the carrier 110 may then be used to press the front surface of the wafer 111 against the polishing pad 108. (Step 701) The polishing pad 108, supported by a rigid platen 211 may then be orbited to planarize the front surface of the wafer 111. The exact orbit rate and radius of orbit is highly dependent on the initial condition and type of wafer being planarized and thus may be optimized as needed. (Step 702) After the wafer 111 has been planarized on the polishing pad 108 it may be transported by the carrier 110 to another portion of the CMP tool. (Step 703) The wafer 111 is preferably cleaned and dried before being returned to its wafer holder. The processing of the wafer 111 on the polishing pad 108 will load the polishing pad 108 with waste material that was removed from the front surface of the wafer 111, thereby glazing the polishing pad 108. In addition, the polishing pad 108 will likely loose its desired planar shape as polishing pad material is removed at a faster rate in areas that received the greatest contact with the wafer 111 during the planarization process.

To condition the polishing pad 108, a rigid conditioning device 107 may be swept across the polishing pad on an arc by an actuator 104. The sweep rate may be, for example, about 35 degrees per second. In addition, the actuator 104 may be used to apply a pressing force on the conditioning device 107. A preferred pressing force is about one to eleven pounds per square inch of force applied to the conditioning device 107. The amount of force may be varied depending on the particular process. Softer polishing pads 108 and/or more aggressive abrasives on the conditioning device 107 will require lower pressing forces. A desired force may be calibrated by adjusting the pressure communicated to a pneumatic actuator 104 until a load cell confirms that a desired pressing force has been obtained. A closed loop pressure control system may then be used to maintain the pressure to the pneumatic actuator 104 to maintain a steady pressing force. The polishing pad 108 may be oscillated, preferably about its central axis, while the conditioning device 107 is swept across the polishing pad 108 to condition the polishing pad 108. A preferred approach is to rotate the polishing pad 108 back and forth, clockwise and counter clockwise, preferably between about plus and minus 45 to 360 degrees and most preferably between plus and minus 180 degrees. The rotation of the polishing pad 108 may be about the central axis of the polishing pad 108 or the central axis of the orbit of the polishing platen 211. Oscillating the rotation of the polishing pad 108 has been found to improve the uniformity of the conditioning process.

Of course, the conditioning parameters of sweep path, sweep speed, pressing force, and abrasive surface roughness may all be optimized for a particular type of polishing pad 108. Polishing pads having greater wear resistant and/or conditioning requirements may need more aggressive conditioning parameters. (Step 704)

As the conditioning device 107 is swept across the polishing pad 108, fluid nozzles 113 on the leading, trailing or both edges of the conditioning device 107 may eject a high-pressure stream of fluid onto the polishing pad 108. The stream of fluid may be used to assist in dissolving, loosening and/or flushing the waste material away. (Step 705) Additional fluid may also be routed up through the rigid platen 211 and polishing pad 208 to assist in flushing material off the polishing pad 108. Oxalic acid has been shown to produce acceptable results for polishing pads 108 loaded with copper while deionized water (possibly with KOH added) has been shown to produce acceptable results for other types of materials loaded in the polishing pad 108. Increased through put for the polishing station 109 may be obtained by conditioning one polishing pad while a wafer is being planarized on the other polishing pad. Alternating the condition device 107 between two or more polishing pads 108 in this manner allows the conditioning device 107 to be used almost continuously thereby improving the through put of the polishing station 109.

Conditioning the polishing pad 108 as described has been shown to reduce wafer-to-wafer nonuniformity from 4% to 1% while improving removal rate by as much as 700 Angstroms per minute in some cases. The removal rate is also maintained during the planarization process better than in the prior art and produces an improved pad wear profile by wearing evenly across the polishing pad 108. The conditioner device 107 as described has also proven to have a longer useful life over the prior art thereby reducing the cost of ownership of the CMP tool.

While the invention has been described with regard to specific embodiments, those skilled in the art will recognize that changes can be made in form and detail without departing from the spirit and scope of the invention.

We claim:

1. An apparatus for conditioning a polishing pad comprising:

a) a rigid elongated element having a top and bottom surface;

b) an abrasive element supported by the bottom surface of the rigid element;

c) a pivot point connected to the top surface of the rigid element;

d) a first platen having a central axis;

e) a first polishing pad supported by the first platen;

f) a first motion generator connected to the first platen for moving the first polishing pad in an orbital motion about an orbital axis and in an alternating clockwise and counter-clockwise oscillating rotational motion, each motion relative to the abrasive element; and g) an actuator connected to the pivot point for pressing the abrasive element against the first polishing pad.

2. The apparatus of claim 1 wherein the bottom surface of the elongated element is planar.

3. The apparatus of claim 1 wherein the abrasive element comprises a diamond layer with raised portions in a grid pattern.

4. The apparatus of claim 1 wherein the pivot point is substantially near the center of the top surface of the rigid element.

5. The apparatus of claim 1 wherein the platen is substantially rigid.

6. The apparatus of claim 1 wherein the actuator is pneumatically controlled.

7. The apparatus of claim 1 further comprising:

h) a second platen;

i) a second polishing pad supported by the second platen;

j) a second motion generator connected to the second platen for moving the second polishing pad in relation to a wafer or in relation to the abrasive element; and k) wherein the actuator is positioned to be able to sweep the abrasive element over either the first polishing pad or the second polishing pad.

8. The apparatus of claim 1 wherein the first platen comprises a rigid planar member having a plurality of fluid feed holes.

9. The apparatus of claim 1 further comprising fluid nozzles attached to the rigid elongated element.

10. The apparatus of claim 1 wherein the first motion generator is configured to move the polishing pad in an alternating clockwise and counterclockwise oscillating rotational motion about the central axis.

11. The apparatus of claim 1 wherein the first motion generator is configured to move the polishing pad in an alternating clockwise and counterclockwise oscillating rotational motion about the orbital axis.

12. A method for planarizing a wafer comprising the steps of:

a) loading a wafer having a front and back surface into a carrier;

b) pressing the front surface of the wafer against a surface of a polishing pad supported by a platen;

c) orbiting the polishing pad in order to uniformly remove material from the front surface of the wafer;

d) removing the wafer from the polishing pad;

e) pressing a rigid conditioning device having an abrasive bottom surface against the surface of the polishing pad;

f) sweeping the conditioning device across the surface of the polishing pad; and g) oscillating the polishing pad in alternating clockwise and counter-clockwise rotational motion during steps e and f to condition the polishing pad.

13. The method of claim 12 wherein the platen is rigid.

14. The method of claim 12 wherein the conditioning device is pressed against the polishing pad with between about 1 and 11 pounds per square inch of abrasive bottom surface.

15. The method of claim 12 wherein the sweep speed of the conditioning device is about 35 degrees per second.

16. The method of claim 12 wherein the oscillating is clockwise and counter-clockwise between about plus and minus 45 and 360 degrees.

17. The method of claim 12 wherein a fluid is pumped through the platen and the polishing pad during steps c and g.

18. The method of claim 12 further comprising the step of spraying a fluid from nozzles attached to the conditioning device onto the polishing pad during step f.

19. A method for conditioning a first and a second polishing pad comprising the steps of:

a) loading a first wafer having a front and back surface into a first carrier;

b) pressing the front surface of the first wafer against a first polishing pad supported by a first rigid platen;

c) orbiting the first polishing pad in order to uniformly remove material from the front surface of the first wafer;

d) during at least part of step c, pressing a rigid conditioning device having an abrasive bottom surface against a second polishing pad supported by a second rigid platen;

e) during at least part of step c, sweeping the conditioning device across the surface of the second polishing pad;

f) during at least part of step c, oscillating the second polishing pad clockwise and counter-clockwise during step e to condition the second polishing pad;

g) removing the first wafer from the first polishing pad;

h) loading a second wafer having a front and back surface into a second carrier;

i) pressing the front surface of the second wafer against the second polishing pad;

j) orbiting the second polishing pad in order to uniformly remove material from the front surface of the second wafer;

k) during at least part of step j, pressing the rigid conditioning device against the surface of the first polishing pad;

l) during at least part of step j, sweeping the conditioning device across the surface of the first polishing pad;

m) during at least part of step j, oscillating the first polishing pad clockwise and counter-clockwise during step l to condition the first polishing pad; and n) removing the second wafer from the second polishing pad.

* * * * *